United States Patent [19]

Hoeck

[11] Patent Number: 4,541,144

[45] Date of Patent: Sep. 17, 1985

[54] TEXTILE-FIBER MIXING CHAMBER

[76] Inventor: Franz Hoeck, Hohkeppeler Strasse 29 A, 5063 Overath 3, Fed. Rep. of Germany

[21] Appl. No.: 618,023

[22] Filed: Jun. 7, 1984

[30] Foreign Application Priority Data

Sep. 16, 1983 [DE] Fed. Rep. of Germany ..... 3320798

[51] Int. Cl.[4] ..... D01G 13/00; B65G 53/40

[52] U.S. Cl. ..... 19/145.5; 19/81; 406/109; 406/167

[58] Field of Search ..... 19/80 R, 81, 145.5, 19/200, 205; 406/109, 167

[56] References Cited

U.S. PATENT DOCUMENTS

| | | | |
|---|---|---|---|
| 1,717,633 | 6/1929 | Stevens | 19/145.5 |
| 2,646,913 | 7/1953 | Goldberg et al. | 19/81 X |
| 2,828,510 | 4/1958 | Schweizer | 19/145.5 |
| 3,487,509 | 1/1970 | Bond | 19/200 X |
| 4,377,021 | 3/1983 | Peters | 19/80 R |

*Primary Examiner*—Louis K. Rimrodt

*Attorney, Agent, or Firm*—Reed Smith Shaw & McClay

[57] ABSTRACT

In order to reduce the sliding friction between an endless conveyor which was up to date constructed as a flexible conveyor belt and the stationary chamber floor of a textile-fiber mixing chamber provided with a pneumatic charging device and an endless conveyor which is moveable over a stationary chamber floor in order to transport the fiber material piled up in the mixing chamber to a blender emptier, the endless conveyor according to the invention is constructed as a conveyor provided with bars which are arranged at intervals and whose ends are fixed to circulating driven endless driving and carrier units.

5 Claims, 4 Drawing Figures

TEXTILE-FIBER MIXING CHAMBER

FIELD OF THE INVENTION

The invention relates to a textile-fiber mixing chamber having a pneumatic charging device and an endless conveyor which can be moved above a stationary chamber floor in order to transport the fibrous material which is contained within the mixing chamber to a removing device at one end of the chamber.

BACKGROUND OF THE INVENTION

Textile-fiber mixing chambers have been disclosed for instance in the DE-PS No. 28 37 785 (equivalent to U.S. Pat. No. 4,264,241, issued Apr. 28, 1981). and in "Sonderdruck aus Melliand Textilberichte 53 (1972), 1216 to 1221". There the charging device is a so-called travelling resp. telescope-fitted cyclone device which is employed for piling up fibrous material in layers within the chamber. The chamber is emptied by a blender emptier or a fiber mixing and removing device which is, for example, constructed as a discharge mill at one end of the chamber. This mill is connected by means of a second telescopic tube to a suction or extraction fan. The second telescopic tube travels together with the blender emptier into the chamber to be emptied. The discharge mill mills off in a vertical direction the material stock within the chamber.

Contrary to known mixing chamber apparatus, the present invention is concerned with mixing chambers for textile fibers where a blender emptier cannot be brought into the mixing chamber. For emptying the mixing chamber, the blender emptier is postioned at an open front end of the mixing chamber. The textile-fiber material is moved into the working area of the blender emptier by an endless conveyor which is supported by the chamber floor. By means of such a system the whole weight of the material stock which is in the chamber presses on the endless conveyor which consists of a flexible conveyor belt, so that considerable abrasion appears between this flexible conveyor belt and the supporting chamber floor. Considerable traction force, therefore, has to be exerted on the conveyor belt, requiring the conveyor belt itself to have considerable tensile strength. On the other hand, increased difficulties occur when transmitting the driving power to such conveyor belt, particularly in mixing chambers with a working width between 2 and 4 m which often have a chamber length between 3 and 20 m and a filling height between 2.5 and 5 m.

Accordingly, the object of the invention is to provide measures for textile-fiber mixing chambers of the foregoing type which lead to a simplified construction of the endless conveyor and reduces susceptibility to problems.

SUMMARY OF THE INVENTION

According to the invention the textile-fiber mixing chamber is characterized in that the endless conveyor is constructed as a conveyor which is provided with bars which are fixed with their ends to continuously-driven endless driving and carrier units.

It has surprisingly appeared that the bars which are preferably arranged in at about 400–500 mm intervals, effect a nonslip motion of the whole material stock which is in the mixing chamber as a homogeneous block. When the material stock is moved forward the parts of the material stock which are between the separate or individual bars, slide directly over the stationary floor of the chamber which brings about essential advantages compared with a conveyor belt which slides over the chamber floor.

The bars are preferably formed with a U-shape which is outwardly open so that it has a positive effect on the motion of the material stock. The driving and carrier means, preferably open-link chains, is such that a positive power transmission exists, which is contrary to the positive power transmission that is realized in connection with a flexible conveyor belt of the prior art.

The bars of the present invention are preferably fixed to the open-link chains by means of offset side bars which are on the one hand fixed at the bottom side of the individual bars and on the other hand to the individual chain links. In this way it is reached that the bars primarily slide on the stationary chamber floor in the area of the parts of the side bars which are fixed to them. For this purpose the chamber floor is preferably provided with a material which favors sliding and is abrasion-proof.

Other advantages of the present invention will be realized by a review of the accompanying drawings, which show by way of example, a presently preferred embodiment of the invention.

BRIEF DESCRIPTION OF THE INVENTION

PRESENTLY PREFERRED EMBODIMENT

Figure 1:
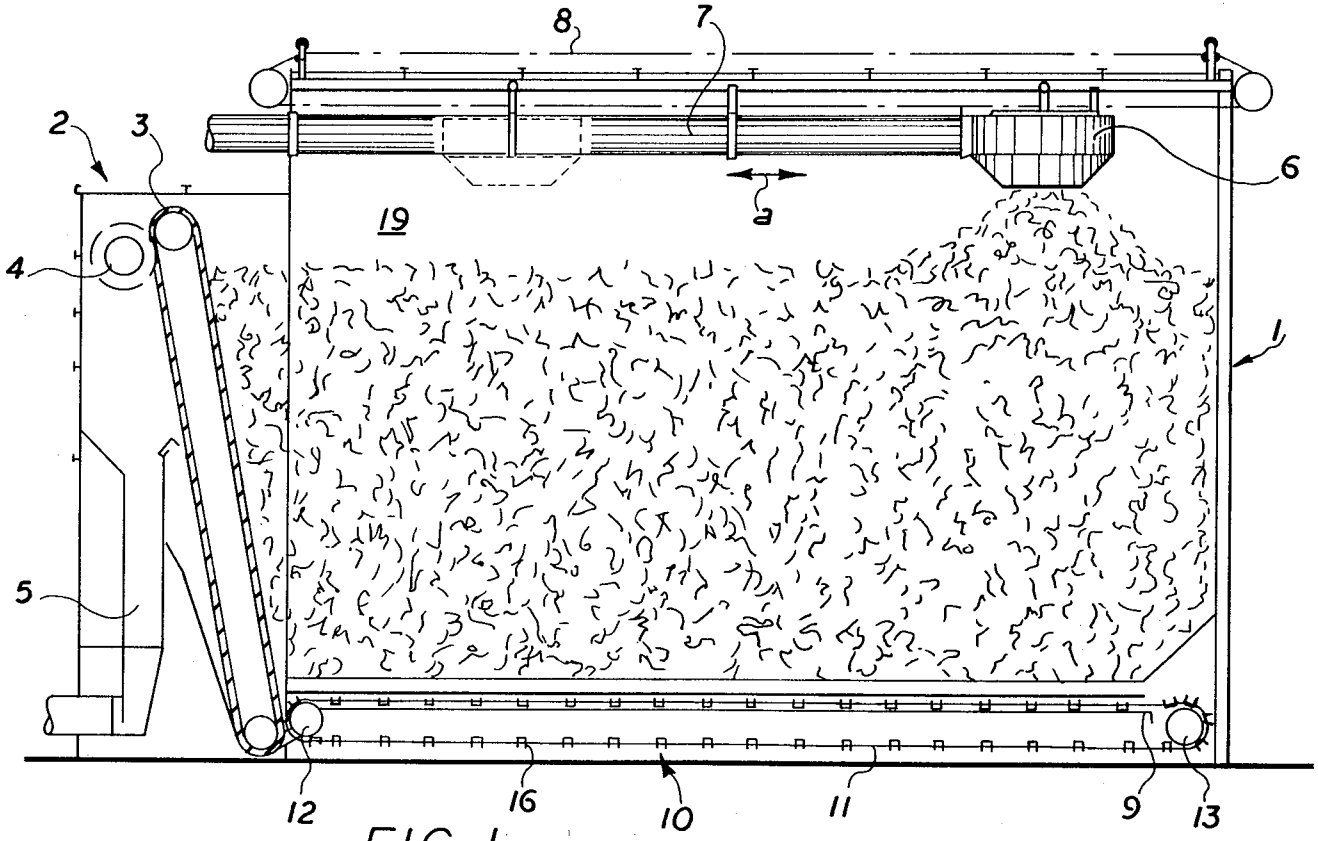
FIG. 1 is a side elevation, partially in section of a textile-fiber mixing chamber during charging.

Referring to the drawings textile-fiber mixing chamber 1 of the present invention is preferably rectangular in shape with a filling height of about 2.5 to 5.0 m, a chamber length of 3 to 20 m, and a working width of 2 to 4 m. One front wall of mixing chamber 1, for example, to the left of the chamber is moveable, such as by means of a sliding wall (not shown). At such opened end is a blender emptier of a fiber mixing and removing device 2, which can be driven and constructed in a known manner, such as an upwardly travelling needle studded belt 3*a*, a detaching roll 3, a penumatic conveying system 5 and travelling means and drive 4 with regulating units.

In operation, after mixing chamber 1 has been filled, the whole stock of material is moved by means of an endless conveyor 10 which is provided with transverse bars 16 moveable over the stationary chamber floor 9 in direction of the blender emptier 2 which is placed in the area of the open chamber wall and from which the fiber material is milled off from the bottom toward the top and is passed over to a pneumatic material conveying system 5.

Conveyor 10 is provided with bars 16 comprising two link chains 11 which proceed at the level of the chamber floor adjacent to the two longitudinal chamber walls 19. Link chains 11 are entrained over round front and rear chain pulleys 12 and 13, respectively; preferably, at least two of which are driven.

The transverse bars 16 which are U-shaped and form the proper conveying elements, are fixed to the individual chain links 14 of chain 11 by means of offset linking bars 15, which are screwed to the underside of each bar 16 at each end thereof. Side linking bars 15 are preferably welded on to the individual chain links 14.

Mixing chamber 1 is charged by means of charging cyclone device 6 connected to telescopic tube 7. Charging cyclone device 6 can be moved longitudinally of the chamber in the direction of the double-ended arrow a by means of a driven hauling cable 8 in order that the fiber material can be charged in layers into the textile-fiber mixing chamber by means of a blower (not shown) connected to the telescopic tube 7.

In the edge regions of its both longitudinally extending upper surfaces the chamber floor 9 is provided with layers 17 of a material which favors sliding and which is abrasion-proof. The width of each layer is such that the upper stringer of link chain 11 as well as the end of the offset side bars 15 which rests upon the bottom and is fixed to the bars 16 slides on this layer.

In the region of their upper stringer link chains 11 are protected by cover strips 18 which are fixed to lateral chamber walls 19; cover strips 18 preferably having elastic qualities at their bottom end 21 which is inclined to the chamber floor 9.

Figure 2:
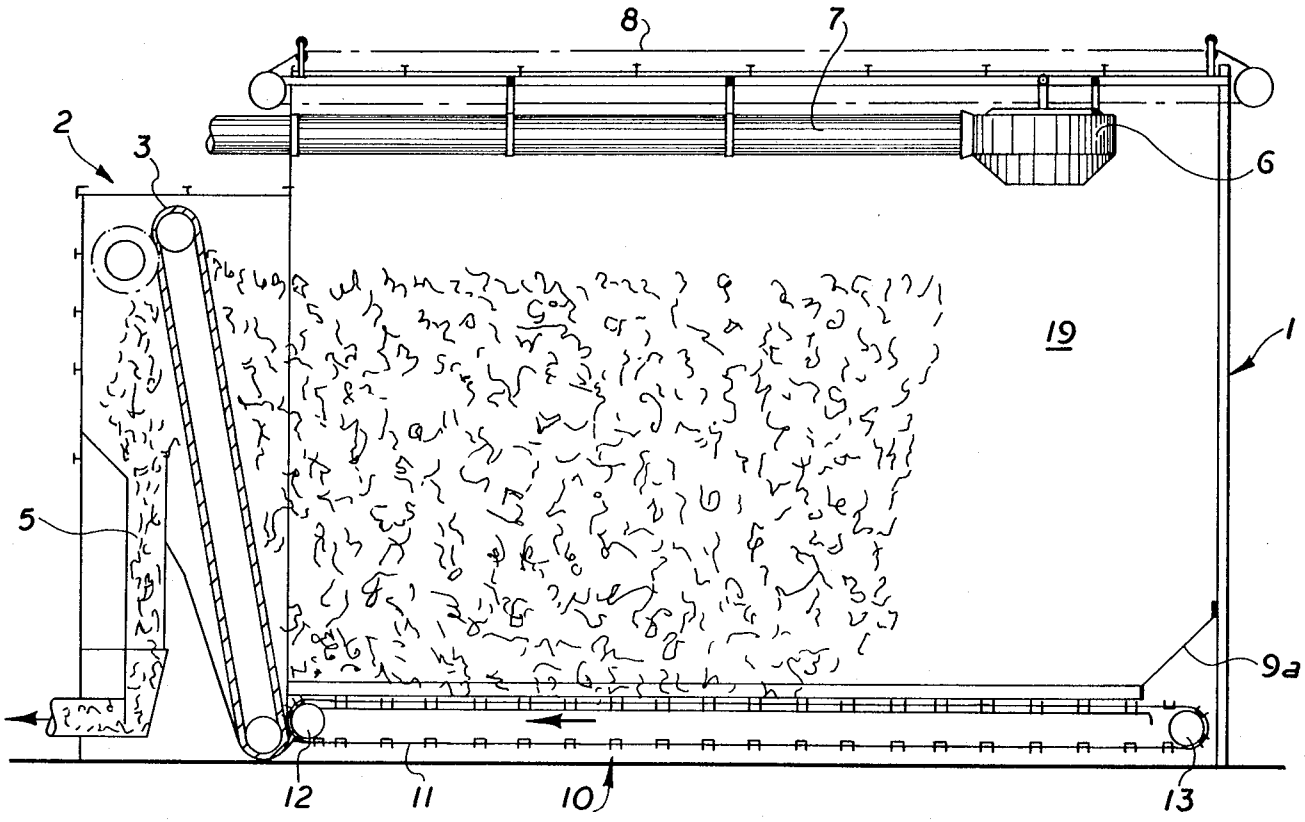
FIG. 2 is a side elevation, partially in section, of the said textile-fiber mixing chamber shown in FIG. 1, but during discharging.
Figure 3:
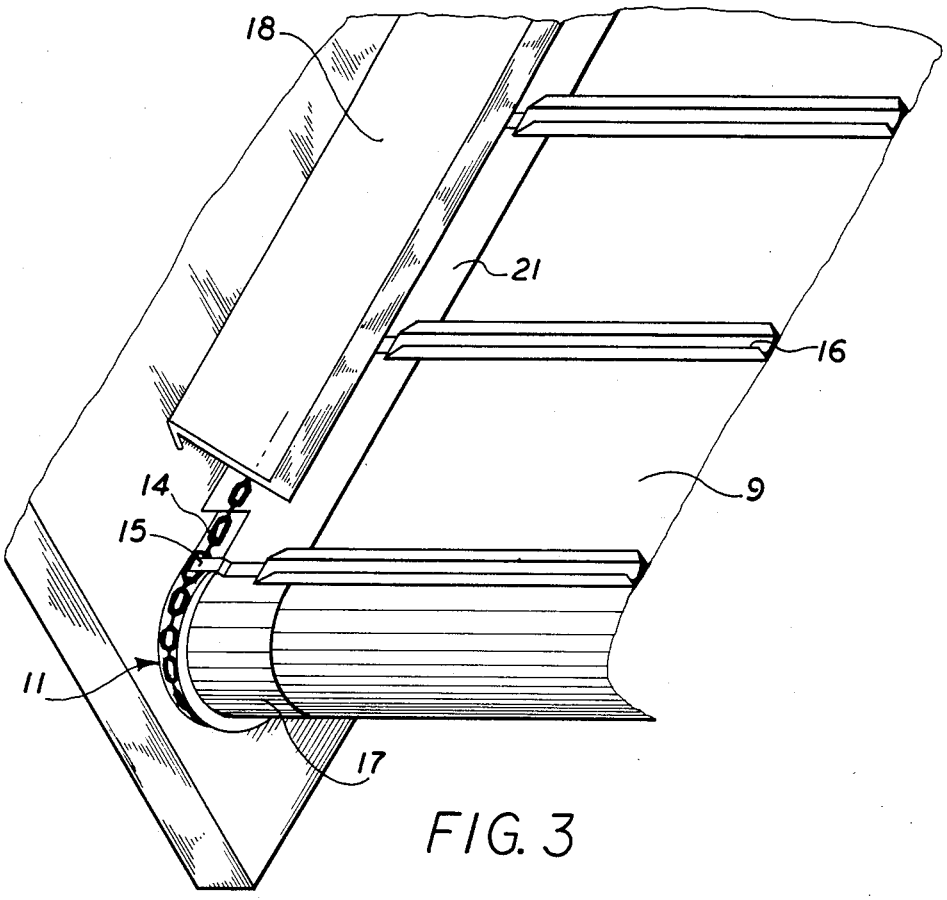
FIG. 3 is a partial perspective elevation of the conveyor which is provided with bars, in the zone of the turn point.
Figure 4:
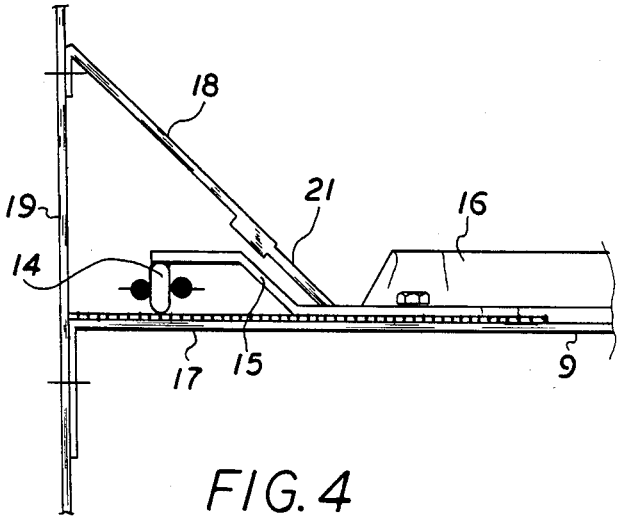
FIG. 4 is a further partial transverse elevation of the conveyor which is provided with bars taken through line IV—IV of FIG. 3.

At its rear (closed) part, material chamber 1 is provided with a sloped floor part **9*a* which covers the rear chain pulleys 13 and slopes towards the top in order that the rear pair of the chain pulleys 13 can be placed within the chamber 1. FIG. 2 shows that the rear of the stock of material which is subject to the oblique floor part 9*a* is largely retained when the stock of material is conveyed in direction of the blender emptier 2, whereby the optimum conveying of the stock of material by a conveyor provided with bars 16** is demonstrated.

While a presently preferred embodiment of the invention has been shown and described in particularity, the invention may be otherwise embodied within the scope of the appended claims.

What is claimed is:

1. In a textile flber mixing chamber comprising an open top for receiving fibrous products to be mixed before other processing, the chamber having a vertical side and back walls to confine the product, having an open front side permitting mixed products to be transported out for removal from said chamber, a stationary floor capable of supporting product, and a motor means for propelling product from said chamber, the improvement comprising a. an endless conveyor belt means disposed adjacent said floor and motively aligned to feed the egress side of the chamber consisting essentially of a parallel pair of endless link chains spaced apart and substantially filling the width of said chamber, being synchronously linked while in movement;

b. a plurality of members each having an outwardly orientated U-profile and extending transversely between the parallel chains, with the lineal distance between successive members being substantially less than the distance between the chain themselves; and c. an offset linking bar disposed at each end of each transverse member with said bar having its lower oriented edge pinned to the base portion of the member end and its upper oriented edge pinned to one link of the abutting endless chain, and with an opposing pair of linking bars positioned between the chains so as to retain the transversely oriented member substantially at right angles to the direction of chain travel.

2. In a textile-fiber mixing chamber according to claim 1, wherein the upper stringers of the link chains are supported by the stationary floor of said mixing chamber.

3. In a textile-fiber mixing chamber according to claim 1, wherein said side bars are on the one side screwed on the bars and on the other side welded on the chain links.

4. In a textile-fiber mixing chamber according to claim 1, wherein said chamber floor is provided in the edge regions of both its longitudinally extending upper surface strips with a layer of a material which favors sliding and is abrasion-proof.

5. In a textile-fiber mixing chamber according to claim 1, wherein the upper stringers of the link chains are protected by cover-plates which are fixed to the lateral chamber walls.

* * * * *

UNITED STATES PATENT AND TRADEMARK OFFICE

CERTIFICATE OF CORRECTION

PATENT NO. : 4,541,144

DATED : September 17, 1985

INVENTOR(S) : Franz Hoeck

It is certified that error appears in the above-identified patent and that said Letters Patent is hereby corrected as shown below:

On the title page insert

-- (73) Assignee: Temafa Textilmaschinenfabrik Meissner Morgner & Co. GMBH, Federal Republic of Germany --.

Signed and Sealed this

*Thirtieth* Day of *September 1986*

[SEAL]

*Attest:*

*Attesting Officer*

DONALD J. QUIGG

*Commissioner of Patents and Trademarks*